US005143748A

United States Patent [19]

Ishikawa et al.

[11] Patent Number: 5,143,748

[45] Date of Patent: Sep. 1, 1992

[54] TIMBER SURFACE IMPROVING TREATMENT PROCESS

[75] Inventors: Hiroyuki Ishikawa; Hiroaki Usui; Yasushi Sawada, all of Kadoma; Satiko Okazaki, 2-20-11, Takaido-Higashi, Suginami-ku, Tokyo; Masuhiro Kogoma, 843-15, Shimoshinkura, Wako-shi, Saitama, all of Japan

[73] Assignees: Matsushita Electric Works, Ltd., Osaka; Satiko Okazai, Tokyo; Masuhiro Kogoma, Wako, all of Japan

[21] Appl. No.: 783,022

[22] Filed: Oct. 25, 1991

[30] Foreign Application Priority Data

Oct. 26, 1990 [JP] Japan ..... 2-289903
Jul. 15, 1991 [JP] Japan ..... 3-173691

[51] Int. Cl.[5] ..... B05D 3/06

[52] U.S. Cl. ..... 427/40; 427/4; 427/249; 427/254; 427/255.1; 427/255.3; 427/297; 427/325; 427/444

[58] Field of Search ..... 427/4, 40, 297, 325, 427/249, 254, 255.1, 255.3, 444

[56] References Cited

U.S. PATENT DOCUMENTS 4,749,440 6/1988 Blackwood et al. .
4,863,809 9/1989 Brar et al. .

*Primary Examiner*—Bernard Pianalto
*Attorney, Agent, or Firm*—Armstrong, Nikaido, Marmelstein, Kubovcik & Murray

[57] ABSTRACT

A surface treatment process for improving surface properties of a timber as to wetness by exposing the timber to a plasma mixture of an inert gas and a reactive gas at a near atmospheric pressure. Prior to being exposed to the plasma mixture, the timber is treated to reduce a moisture content below a fiber saturation point of the timber so as to eliminate free moisture from the fibers of the timber which would otherwise lead to unstable plasma and therefore detract an uniform improvement over substantially the entire surface expected at the subsequent exposure to the plasma mixture. Thus, the plasma treatment can be effected in the absence of the free moisture to obtain a desired surface improvement uniformly across the surface of the timber, which gives an enhanced practicability of improving the surface properties of the timber, in addition to that the plasma mixture is generated at near the atmospheric pressures readily available without requiring substantial vacuum generating equipments.

6 Claims, 2 Drawing Sheets

TIMBER SURFACE IMPROVING TREATMENT PROCESS

BACKGROUND OF THE INVENTION

1. Field of the Invention

The present invention is directed to a timber surface improving treatment process, and more particularly to a plasma process of improving surface properties of the timber by exposure to a plasma mixture at near atmospheric pressure.

2. Description of the Prior Art

For many years there have been constant demands for improving surface properties of a timber. Particularly, surface wetness is of a major concern in that a hydrophilic property is required for giving improved adhesiveness and printability to the timber while a hydrophobic property is required for giving water-repellant property to the timber. To this end, surface coatings have been generally employed in order to modify the surface properties of the timber. However, such coatings will certainly impair woodenness, and further pose another problem as to durability and weatherability in that the coating might be flaked off during an extended life of use in outdoors or in water-exposure conditions.

In the meanwhile, there have been known plasma processes for improving surface properties of an article such as plastics, silicon, and magnetic data storage media, as disclosed in U.S. Pat. Nos. 4,749,440 and 4,863,809. However, because such plasma process requires a high level of vacuum to generate a plasma by glow-discharging, its application to surface improvement of timber inherently containing water or moisture is practically impossible in that a stable plasma could not be obtained in the presence of the vapor of the moisture appearing at such high level of vacuum. On the other hand, some recent developments enable a plasma surface treatment at near atmospheric pressures, as proposed in Japanese non-examined early publication (KOKAI) Nos. 1-306569 and 2-15171 which teach the generation of a plasma mixture of an inert gas and a reactive monomer gas by glow-discharging at near atmospheric pressure to deposit a polymerized film on the surface of an article such as ceramics, glasses, plastics, and metals. With the advent of the plasma process at near atmospheric pressures, it is contemplated to apply the plasma process to timber for improving surface properties thereof. In anticipation that timber could be improved over a large surface area by such plasma process, attempts have been made by the inventors. Nevertheless, only insufficient surface improvement is obtained with this plasma process contrary to what would be expected, although the plasma is successfully generated.

SUMMARY OF THE INVENTION

Much study has been concentrated on the above problem and reveals that moisture inherently contained in the timber appears in the surface during the plasma treatment and acts to partially cover the timber fibers so as to suppress uniform surface improvement over an extended surface area. Through further study, it is also revealed that substantially uniform surface treatment with expected improvement can be achieved by the plasma process at near atmospheric pressures when the timber is pretreated to have a moisture content below its fiber saturation point. The fiber saturation point refers to a condition at which no free moisture is present in the timber to leave cell membrane saturated with bound water. The fiber saturation point differs in different species of timber but normally corresponds to a moisture content of about 30%. The moisture content of timber is defined by the following formula:

$$\text{Moisture Content (\%)} = \frac{W_1 - W_0}{W_0} \times 100$$

wherein W1 is a weight (g) of the timber before being dried, and W0 is a dry weight of the timber after being dried at 105 ° C. with the use of a thermostat up to a constant weight.

The present invention, therefore, discloses a novel timber surface improving treatment process which comprises the steps of adjusting a moisture content of timber below a fiber saturation point for said timber, and exposing the timber to a plasma mixture generated by glow-discharging at near atmospheric pressures. The plasma mixture comprises an inert gas and a reactive gas including at least one element selected from the group consisting of C, N, 0, F, and S. The reactive gas includes, but not limited thereto, fluoride gas such as CF4, NF3, and SF3 which are believed to fluorinate the cellulose in the surface of the timber for imparting water repellant properties, and includes O2 which is believed to attach hydrophilic groups to the cellulose in the surface of the timber for imparting a hydrophilic property. Preferably, the fluoride gas and oxygen are intermixed in a suitable ratio in order to obtain a controlled hydrophilic property. The inert gas is essential for generating a glow-discharging plasma at near atmospheric pressures and includes, but is not limited thereto, He, Ar, and Ne. Nitrogen N2 gas may be additionally supplied in order to enhance surface activation of the timber with the plasma mixture of the inert gas and the reactive gas or to effect plasma etching prior to imparting a hydrophilic or hydrophobic property by the reactive gas. As described in the above, the plasma treatment process can successfully improve the timber surface uniformly across the surface of the timber which has been pretreated to reduce its moisture content at least to a fiber saturation point, and in addition, the plasma process can be readily conducted at near atmospheric pressures.

Accordingly, it is a primary object of the present invention to provide a novel timber surface improving plasma treatment process which is capable of assuring expected surface improvement uniformly across the surface of the timber.

The plasma process can be carried out at a near atmospheric pressure within a pressure range of 500 to 1500 mmHg, which is readily available without requiring expensive high vacuum or pressure generating facilities. Thus, the plasma treatment can be performed in an economical manner to increase the practical feasibility in an industrial application, which is therefore another object of the present invention.

Preferably, the reactive gas is contained in the inert gas in a molar ratio of less than 0.3 to 1, and the glow-discharge is effected by applying an alternate voltage between a pair of electrodes at an electric power flux density of 0.02 to 6.0 Watts per square centimeter of the electrode and at a high frequency in the range of 1 kHz to 13.56 MHz.

When imparting a hydrophobic or water repellant property with a plasma of the reactive gas, for example, CF4, NF3, and SF6, it is mostly preferred to continue supplying the reactive gas with or without the inert gas after finishing the plasma treatment in order to complete the reaction of the still remaining reactive surface of the timber with the newly supplied reaction gas, thereby leaving no substantial activated surface which would otherwise react with oxygen to form a hydrophilic group when exposed to the open air and would therefore adversely lower the hydrophobic property.

These and still other objects and advantageous features will become more apparent from the following detailed description of the invention in conjunction with the attached drawings.

DETAILED DESCRIPTION OF THE INVENTION

Figure 1:
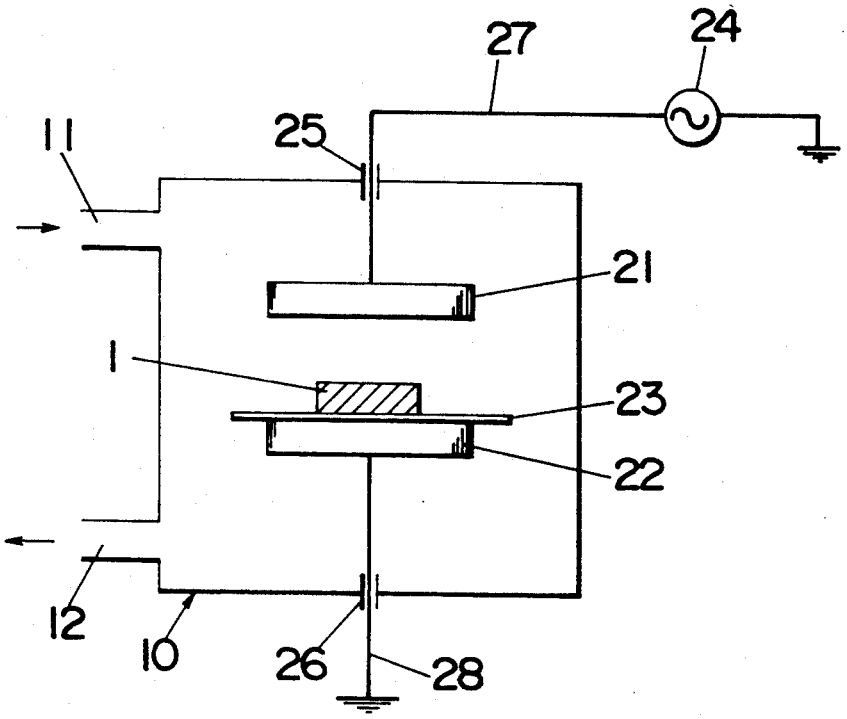
FIG. 1 is a schematic view of a plasma chamber utilized in a timber surface improving plasma treatment process in accordance with a preferred embodiment of the present invention.

Referring now to FIG. 1, there is shown in a highly schematic representation of a plasma chamber 10 employed in the present invention for surface treatment of a timber 1 The chamber 10 is provided with an inlet 11 and an outlet 12 for constantly supplying a mixture gas through the inlet 11 at a controlled flow rate and discharging it through the outlet 12. The mixture gas comprises an inert gas and a reactive gas mixed in a suitable proportion. The inert gas includes He, Ar, and Ne. The reactive gas includes CF4, NF3, and O2. SF6 may be likewise available as the reactive gas. Nitrogen N2 gas may be additionally supplied together with the inert and reactive gases to enhance surface activity of the timber by the plasma mixture of the inert gas and the reactive gas or to effect the plasma etching. The chamber 10 is also provided with a parallel pair of upper and lower electrodes 21 and 22 in the form of a disk having a diameter of 160 mm, and a solid dielectric 23 which is also a disk-shaped member having a diameter of 180 mm and placed concentrically upon the lower electrode 22 to support thereon the timber 1. The dielectric 23, which is made of, for example, glasses, ceramics, plastics or the like, may be alternately placed upon the upper electrode 21, or be placed both upon the upper and lower electrodes 21 and 22. A high frequency alternating voltage power source 24 is connected to apply an AC voltage between the electrodes 21 and 22 to cause glow discharge therebetween so as to generate a plasma of the mixture gas supplied into the chamber 10 for exposing the timber 1 to the resulting plasma mixture at near atmospheric pressures in the range of 500 to 1500 mmHg. The chamber 10 is provided with insulator sleeves 25 and 26 fitted around a high voltage line 27 and a ground line 28. When the voltage is applied at such a high frequency as to cause considerable heating, a cooling device may be required to cool the timber or the plasma treatment may be finished in a relatively short period of time in order to avoid carbonization of the timber 1.

The following examples are set forth for the purpose of illustration, and any specific enumeration of detail contained therein should not be interpreted as a limitation on the concept of this invention.

EXAMPLE 1

Timber pieces of Japanese cypress were cut to have a sample size of 100×100×5.0 mm thick. The timber pieces having an initial moisture content of 100% were dried at 105° C. for 10 hours to reduce its moisture content down to 5% less than a saturation point of 30% specific to the Japanese cypress. A thus pretreated timber piece was placed between 160 mm diameter disk-shaped electrodes 21 and 22 spaced by a distance of 20 mm in the chamber 10 of FIG. 1, and was subjected to a plasma treatment which was performed with a plasma mixture of He and CF4 for imparting a water repellant property to the surface of the timber piece. He gas was supplied as the inert gas at a flow rate of 2000 sccm (cubic centimeter per minute at a standard condition at 25° C. and 760 mmHg), while CF4 was supplied together therewith as the reactive gas at a flow rate of 50 sccm. While continuously supplying the mixture gas into the chamber, an AC voltage was applied across the electrodes at a frequency of 5 kHz with an electric power of 150 W and at a pressure level of 760 mmHg for 1 minute to bring about glow discharge for generation of the plasma mixture.

Figure 2:
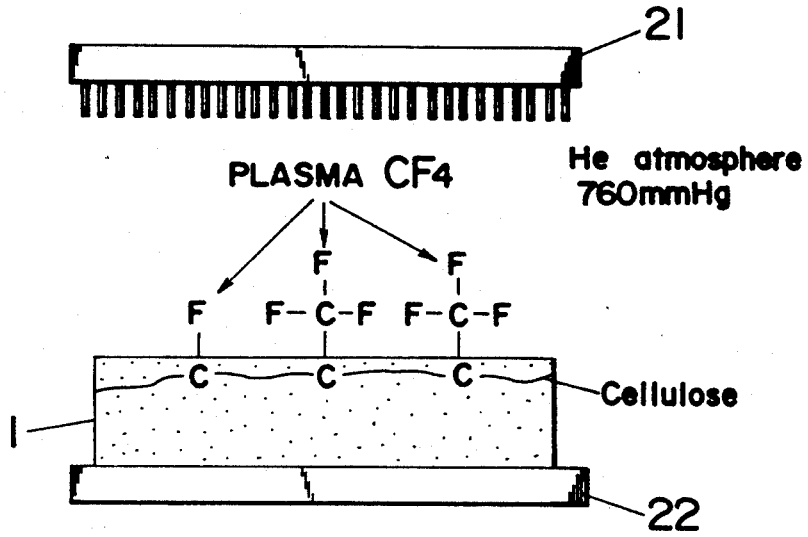
FIG. 2 is a schematic view illustrating a surface improvement mechanism of the timber achieved in the process of the present invention.

For evaluation of the water repellant property, the contact angle with a water drop was measured with regard to thus plasma treated timber piece and also to the non-plasma treated timber piece having 5% moisture content. The measurements were made at three different points which were evenly spaced along a diagonal of the square timber pieces, as indicated by points A, B, and C in FIG. 3, for evaluation of the uniformity of the timber surface condition. The result was that the plasma treated timber piece was found to have contact angles of 115, 117 and 114 degrees at the three points, which is indicative that the timber surface are uniformly improved to have enhanced water repellant property in view of that the non-plasma treated timber piece an average contact angle of 80 degrees. No change was found in the contact angle for the plasma treated timber piece even after it was washed with a fluorohydrocarbon surface cleaning agent sold under the trade name of "Daiflon" from Daikin Kogyo, Japan. Consequently, the plasma treated timber piece is found to give water repellant property due to the increased contact angle with the water drop over the entire surface thereof. The above plasma mixture gas constituents and plasma treatment conditions are listed in Table 1 together with the measured contact angles at the above-defined three spaced points (the upper, middle and lower values in Table 1 corresponding to the measurements respectively at points A, B, and C of FIG. 3). Such surface improvement of the timber is believed to result from that the cellulose in the surface layer becomes fluorinated by exposure to plasma CF4. That is, as shown in FIG. 2, ionized reactive gas of CF4 will react with the surface of the timber to form cellulose-fluorine and/or cellulose-fluoride bonding which reduces surface energy and therefore increases the contact angle with the water drop responsible for the water repellant property. Since the fluorination of the cellulose is limited only to the surface of the timber, the desired surface improvement can be successfully obtained without impairing wooden of the timber.

EXAMPLE 2

Timber pieces of Japanese cypress cut to the above sample size and having an initial moisture content of 100% were dried at 105° C. for 5 hours to have a reduced moisture content of 10% below its saturation point. A thus pretreated timber piece was exposed to the plasma mixture of He and CF4 in the identical conditions as in Example 1 to obtain a plasma treated timber piece. Then, the contact angle was examined with regard to thus plasma treated timber piece and also to the non-plasma treated timber piece for evaluation of the water repellant property. The result was that the plasma treated timber piece had contact angles of 109, 110, and 113 degrees at the three points, while the non-plasma treated timber piece has an average contact angle of 80 degrees. No change in the contact angle was observed for the plasma-treated timber piece even after being washed with "Daiflon".

EXAMPLE 3

Timber pieces of Japanese cypress were cut to the sample size having 100% moisture content and were dried at 105° C. for 3 hours to have a reduced moisture content of 20% below their saturation point. A thus pretreated timber piece was exposed to the plasma mixture of He and CF4 in the identical conditions as in Example 1 to obtain the plasma treated timber piece. Then, the contact angle was examined for thus plasma treated timber piece and also for the non-plasma treated timber piece for evaluation of the water repellant property. The plasma-treated timber piece was found to have contact angles of 98, 99, and 102 degrees with the water drop at the three points, while the non-plasma treated timber piece had an average contact angle of 80 degrees. Also, no change in the contact angle was observed for the plasma-treated timber piece even after being washed with "Daiflon".

COMPARATIVE EXAMPLE 1

Timber pieces of Japanese cypress were cut to the sample size having 100% moisture content. Without the pretreatment, the timber piece was subject to the plasma treatment in the identical condition as in Example 1 in an attempt to impart water repellant property. The resulting plasma treated timber piece was found to have contact angles of 85, 86 and 83 degrees respectively at the three points, while the non-plasma treated timber piece has an average contact angle of 80 degrees. No change in the contact angle was recognized for the plasma-treated timber piece even after being washed with "Daiflon".

EXAMPLE 4

Timber pieces of Japanese cypress cut to the sample size were pretreated in the same condition as in Example 1 to have a reduced moisture content of 5%. A thus pretreated timber piece was subjected to a plasma treatment with a plasma mixture of He, CF4, and O2 for imparting a controlled hydrophilic property to the timber piece. The plasma treatment was performed while supplying He, CF4, and O2 at the respective flow rates of 4000, 20, 50 sccm and applying an electric power of 50 W at a frequency of 3 kHz and at a pressure of 760 mmHg for 2 minutes, as listed in Table 1. The resulting plasma treated timber piece was found to have contact angles of 13, 21, and 25 degrees with the water drop at the three points, while the non-plasma treated timber piece has an average contact angle of 80 degrees for the three points. No change in the contact angle was observed for the plasma-treated timber piece even after being washed with "Daiflon".

EXAMPLE 5

Timber pieces of Japanese cypress cut to the sample size were pretreated in the same condition as in Example 2 to have a reduced moisture content of 10%. A thus pretreated timber piece was subjected to the like plasma treatment as in Example 4. The resulting plasma treated timber piece was found to have contact angles of 24, 29 and 21 degrees with the water drop at the three points, while the non-plasma treated timber piece has an average contact angle of 80 degrees. Also in this example, no change in the contact angle was observed for the plasma-treated timber piece even after being washed with "Daiflon".

EXAMPLE 6

Timber pieces of Japanese cypress having the sample size were pretreated in the same condition as in Example 3 to have a reduced moisture content of 20%. A thus pretreated timber piece was subjected to the like plasma treatment as in Example 4. The resulting plasma treated timber piece was found to show reduced contact angles of 31, 38 and 35 degrees with the water drop at the three points, while the non-plasma treated timber piece shows an average contact angles of 80 degrees. Also, no change in the contact angle was observed for the plasma-treated timber piece even after being washed with "Daiflon".

COMPARATIVE EXAMPLE 2

Timber pieces of Japanese cypress were cut to the sample size having 100% moisture content. Without the pretreatment, the timber piece was subjected to the plasma treatment in the identical conditions as in Example 4 in an attempt to impart a controlled hydrophilic property. The resulting plasma treated timber piece was found to show contact angles of 56, 63 and 59 degrees with the water drop at the three points, while the non-plasma treated timber piece shows an average contact angles of 80 degrees. Also, no change in the contact angle was observed for the plasma-treated timber piece even after being washed with "Daiflon".

TABLE 1

| | | plasma gas mixture | | Plasma generating conditions | | | | | | Evaluation | |
|---|---|---|---|---|---|---|---|---|---|---|---|
| | moisture content (%) | inert gas & reactive gas | flow rate (sccm) | frequency (KHz) | power (W) | electrode distance (mm) | process time (min) | post-plasma gas-flow treatment | pressure (mmHg) | contact angle (deg) #1 | coating adherence (point) #2 |
| Example 1 | 5 | He<br>$CF_4$ | 2000<br>50 | 5 | 150 | 20 | 1 | none | 760 | 115<br>117<br>114 | N/A |
| Example 2 | 10 | He<br>$CF_4$ | 2000<br>50 | 5 | 150 | 20 | 1 | none | 760 | 109<br>110 | N/A |

TABLE 1-continued

| | moisture content (%) | plasma gas mixture: inert gas & reactive gas | plasma gas mixture: flow rate (sccm) | Plasma generating conditions: frequency (KHz) | power (W) | electrode distance (mm) | process time (min) | post-plasma gas-flow treatment | pressure (mmHg) | Evaluation: contact angle (deg) #1 | coating adherence (point) #2 |
|---|---|---|---|---|---|---|---|---|---|---|---|
| | | | | | | | | | | 113 | |
| Example 3 | 20 | He | 2000 | 5 | 150 | 20 | 1 | none | 760 | 98 | N/A |
| | | $CF_4$ | 50 | | | | | | | 99 | |
| | | | | | | | | | | 102 | |
| Example 4 | 5 | He | 4000 | 3 | 50 | 20 | 2 | none | 760 | 13 | N/A |
| | | $CF_4$ | 20 | | | | | | | 21 | |
| | | $O_2$ | 50 | | | | | | | 25 | |
| Example 5 | 10 | He | 4000 | 3 | 50 | 20 | 2 | none | 760 | 24 | N/A |
| | | $CF_4$ | 20 | | | | | | | 29 | |
| | | $O_2$ | 50 | | | | | | | 21 | |
| Example 6 | 20 | He | 5000 | 3 | 50 | 20 | 2 | none | 760 | 31 | N/A |
| | | $CF_4$ | 20 | | | | | | | 38 | |
| | | $O_2$ | 50 | | | | | | | 35 | |
| Comparative Example 1 | 100 | He | 2000 | 5 | 150 | 20 | 1 | none | 760 | 85 | N/A |
| | | $CF_4$ | 50 | | | | | | | 86 | |
| | | | | | | | | | | 83 | |
| Comparative Example 2 | 100 | He | 4000 | 3 | 50 | 20 | 2 | none | 760 | 56 | N/A |
| | | $CF_4$ | 20 | | | | | | | 63 | |
| | | $O_2$ | 50 | | | | | | | 59 | |

Figure 3:
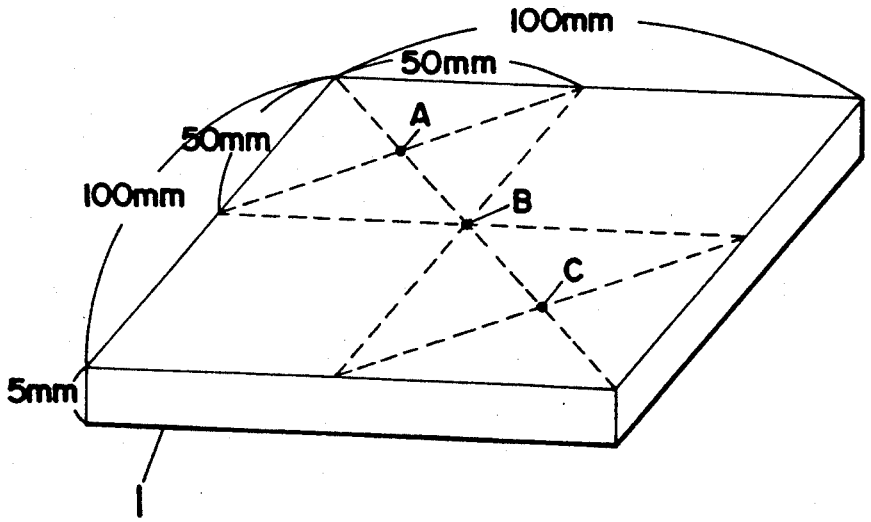
FIG. 3 is a schematic view illustrating three spaced points on a timber piece at which contact angles with a water drop are measured for evaluation of the water repellant property of the associated Examples.

#1 measured at three evenly spaced points along diagonal of a 100 × 100 square timber piece, as shown in FIG. 3
#2 evaluated in accordance with testing method JIS K-5400, 8-5-2.
N/A not available

EXAMPLE 7

A timber piece of oak cut to the sample size was dried at 105° C. for 6 hours to reduce its moisture content down to 10% which is below a saturation point of 30% specific to the oak. A thus pretreated timber piece was subjected to a plasma treatment with a plasma mixture of He and CF4 for imparting a water repellant property. The plasma treatment was performed while supplying He and CF4 at the respective flow rates of 5000 and 100 sccm and applying an electric power of 100 W at a frequency of 10 kHz and at a pressure of 760 mmHg for 1 minute. After completing the plasma treatment, CF4 was kept continuously supplied into the chamber for 1 minute in order to complete the reaction of the still remaining reactive surface of the timber piece with the newly supplied reaction gas, thereby leaving no substantial activated surface which would otherwise react with oxygen to form a hydrophilic group when exposed to the open air and would therefore adversely lower the hydrophobic property. After this post-plasma gas-flow treatment, the above prescribed three point contact angle measurement was made to the resulting timber piece. The result is that the timber piece shows increased contact angles of 98, 103 and 100 degrees with the water drop at the three points, well indicative of that the timber surface is uniformly improved to have an enhanced water repellant property uniformly over the entire surface thereof. The measured contact angles are listed in Table 2 together with the plasma generating conditions.

TABLE 2

| | moisture content (%) | plasma gas mixture: inert gas & reactive gas | plasma gas mixture: flow rate (sccm) | Plasma generating conditions: frequency (KHz) | power (W) | electrode distance (mm) | process time (min) | post-plasma gas-flow treatment | pressure (mmHg) | Evaluation: contact angle (deg) #1 | coating adherence (point) #2 |
|---|---|---|---|---|---|---|---|---|---|---|---|
| Example 7 | 10 | He | 5000 | 10 | 100 | 20 | 1 | yes | 760 | 98 | N/A |
| | | $CF_4$ | 100 | | | | | | | 103 | |
| | | | | | | | | | | 100 | |
| Example 8 | 5 | He | 5000 | 10 | 100 | 20 | 1 | yes | 760 | 112 | N/A |
| | | $CF_4$ | 100 | | | | | | | 109 | |
| | | | | | | | | | | 109 | |
| Example 9 | 5 | He | 5000 | 15 | 150 | 30 | 2 | yes | 760 | 117 | N/A |
| | | $CF_4$ | 200 | | | | | | | 123 | |
| | | | | | | | | | | 119 | |
| Example 10 | 5 | He | 5000 | 10 | 100 | 20 | 2 | yes | 760 | 121 | N/A |
| | | $NF_3$ | 100 | | | | | | | 119 | |
| | | | | | | | | | | 122 | |
| Example 11 | 5 | He | 5000 | 10 | 100 | 20 | 1 | yes | 760 | 35 | N/A |
| | | $O_2$ | 100 | | | | | | | 45 | |
| | | | | | | | | | | 41 | |
| Example 12 | 10 | He | 5000 | 10 | 100 | 20 | 1 | none | 760 | 93 | N/A |
| | | $CF_4$ | 100 | | | | | | | 88 | |
| | | | | | | | | | | 91 | |
| Example 13 | 5 | He | 5000 | 10 | 100 | 20 | 1 | none | 760 | N/A | 8 |
| | | $O_2$ | 100 | | | | | | | | |
| Example 14 | 10 | He | 5000 | 10 | 100 | 20 | 1 | yes | 550 | 93 | N/A |
| | | $CF_4$ | 100 | | | | | | | 88 | |
| | | | | | | | | | | 92 | |
| Example 15 | 10 | He | 5000 | 10 | 100 | 20 | 1 | yes | 630 | 97 | N/A |
| | | $CF_4$ | 100 | | | | | | | 92 | |
| | | | | | | | | | | 95 | |
| Example 16 | 10 | He | 5000 | 10 | 100 | 20 | 1 | yes | 700 | 101 | N/A |
| | | $CF_4$ | 100 | | | | | | | 100 | |

TABLE 2-continued

| | moisture content (%) | plasma gas mixture: inert gas & reactive gas | plasma gas mixture: flow rate (sccm) | Plasma generating conditions: frequency (KHz) | power (W) | electrode distance (mm) | process time (min) | post-plasma gas-flow treatment | pressure (mmHg) | Evaluation: contact angle (deg) #1 | coating adherence (point) #2 |
|---|---|---|---|---|---|---|---|---|---|---|---|
| | | | | | | | | | | 101 | |
| Example 17 | 10 | He | 5000 | 10 | 100 | 20 | 1 | yes | 1000 | 95 | N/A |
| | | $CF_4$ | 100 | | | | | | | 93 | |
| | | | | | | | | | | 98 | |
| Example 18 | 10 | He | 5000 | 10 | 100 | 20 | 1 | yes | 1250 | 91 | N/A |
| | | $CF_4$ | 100 | | | | | | | 88 | |
| | | | | | | | | | | 87 | |
| Example 19 | 10 | He | 5000 | 10 | 100 | 20 | 1 | yes | 1450 | 93 | N/A |
| | | $CF_4$ | 100 | | | | | | | 89 | |
| | | | | | | | | | | 87 | |
| Comparative Example 3 | 50 | He | 5000 | 10 | 100 | 20 | 1 | yes | 760 | 88 | N/A |
| | | $CF_4$ | 100 | | | | | | | 89 | |
| | | | | | | | | | | 92 | |
| Comparative Example 4 | 50 | He | 5000 | 10 | 100 | 20 | 1 | yes | 760 | 47 | N/A |
| | | $O_2$ | 100 | | | | | | | 54 | |
| | | | | | | | | | | 50 | |
| Comparative Example 5 | 10 | He | 5000 | 10 | 100 | 20 | 1 | yes | 400 | 83 | N/A |
| | | $CF_4$ | 100 | | | | | | | 85 | |
| | | | | | | | | | | 86 | |
| Comparative Example 6 | 10 | He | 5000 | 10 | 100 | 20 | 1 | yes | 1750 | 87 | N/A |
| | | $CF_4$ | 100 | | | | | | | 85 | |
| | | | | | | | | | | 82 | |
| Comparative Example 7 | 5 | none | | | | | | | | N/A | 6 |
| Comparative Example 8 | 50 | none | | | | | | | | 61 | N/A |
| | | | | | | | | | | 59 | |
| | | | | | | | | | | 62 | |

#1 measured at three evenly spaced points along diagonal of a 100 × 100 square timber piece, as shown in FIG. 3
#2 evaluated in accordance with testing method JIS K-5400, 8-5-2.
N/A not available

EXAMPLES 8 to 11

Timber pieces of oak cut to the sample size and pretreated at 105° C. to have a reduced moisture content of 5% were exposed to the plasma mixture of He and CF4 generated at different conditions as listed in Table 2 to obtain individual plasma treated timber pieces. After finishing the plasma treatment, CF4 gas was continuously supplied into the chamber for 1 minute for the purpose of leaving no substantial activated surface and therefore preventing the degradation in the hydrophobic property. The resulting plasma treated timber was examined with regard to the contact angle with the water drop at the above prescribed three points on the timber surface. The measured contact angles are listed in Table 2.

EXAMPLE 12

A timber piece of oak cut to the sample size was pretreated and then subjected to the plasma treatment in the identical conditions as in Example 7 but without the post-plasma gas-flow treatment. Then, the three-point contact angle measurement was made to the resulting timber piece to give the individual measured values for the three spaced points, as listed in Table 2.

EXAMPLE 13

A timber piece of oak cut to the sample size was pretreated at 105° C. to have a reduced moisture content of 5% and then subjected to a plasma mixture of He and O2 in the listed conditions in Table 2 for imparting a hydrophilic property. No post-plasma gas-flow treatment was performed, as opposed to Examples 7 to 12. Thereafter, the timber piece was coated with a urethane resin coating for evaluation of coat adherence to the timber surface by means of cross-cut tape test in accordance with a testing method prescribed in JIS (Japanese Industrial Standard) K-5400, 8-5-2. JIS K-5400 8-5-2 sets forth procedure to make 1 mm spaced apart horizontal and vertical cuts in the surface of the coating so as to present a total of 100 squares in the area of 1 $cm^2$. A pressure-sensitive adhesive tape is placed on the coating to be firmly adhered thereto by applying a rubbing over the tape. Thereafter, the tape is peeled off instantaneously with the one end of the tape pulled upward to observe the condition of the cuts in the coating. Evaluation is given in accordance with the following table in which larger evaluation points indicated superior coating adherence.

Evaluation Table <JIS-K5400, 8-5-2>

| point | Observed conditions of the cuts |
|---|---|
| 10 | Every cut is left thin with smooth edges, and no coating flake is seen either at the whole area of every square or even at intersections of cuts. |
| 8 | Coating flake is seen only at some intersections to a slight extent but does not extend over the whole area of any squares, and flaked area remains 5% or less of the total area. |
| 6 | Coating flake is seen both at the edges and at the intersections of the cuts, and flaked area occupies 5 to 15% of the total area. |
| 4 | Coating flake is seen to extend over the edges of the cuts, and flaked area occupies 15 to 35% of the total area. |
| 2 | Coating flake is seen to extend over the edges of the cut to a greater width than seen at point 4, and flaked area occupies 35 to 65% of the total area. |
| 0 | Flaked area reaches 65% or more of the total area. |

Thus evaluated coating adherence for the timber pieces are listed in Table 2.

EXAMPLES 14 to 19

Timber pieces of oak cut to the sample size and pretreated to have a reduced moisture content of 10% were subjected to a plasma treatment followed by the post-plasma gas-flow treatment in the identical conditions as in Example 7 except that the plasma treatment was performed at differing pressures of 550, 630, 700, 1000, 1250, and 1450 mmHg as listed in Table 2. The three point contact angle measurement was made to the individual timber pieces. The results are listed in Table 2.

COMPARATIVE EXAMPLE 3

A timber piece of oak cut to the sample size and pretreated to have a moisture content of 50% (above the fiber saturation point) was subjected to the plasma treatment with a plasma mixture of He and CF4 followed by being subjected to the post-plasma gas-flow treatment in the identical conditions as in Example 7. Thus treated timber piece was tested to give contact angles with the water drop at the three points, as listed in Table 2.

COMPARATIVE EXAMPLE 4

A timber of oak cut to the sample size and pretreated to have a moisture content of 50% was subjected to the plasma treatment followed by the post-plasma gas-flow treatment in the identical conditions as in Example 7 except that it was exposed to a plasma mixture of He and O2 for imparting hydrophilic property. Thus treated timber piece was tested to give contact angles with the water drop at the three points, as listed in Table 2.

COMPARATIVE EXAMPLES 5 AND 6

Timber pieces of oak cut to the sample size and pretreated to have a reduced moisture content of 10% were subjected to a plasma treatment followed by the post-plasma gas-flow treatment in the identical conditions as in Example 7 except that the plasma treatment was performed at differing pressures of 400 and 1750 mmHg, respectively, as listed in Table 2. The contact angle with the water drop was measured for the individual timber pieces at the three points to give respective values, as listed in Table 2. The reduced contact angles or insufficient water repellant property obtained for comparative Example 5 is thought to come from the fact that moisture contained in the timber appears in the surface at such decompressed pressure to hinder the fluorinating reaction between CF4 and the timber surface. On the other hand, the like insufficient water repellant property of comparative Example 6 is thought to result from that stable gas discharge or plasma mixture becomes difficult at such increased pressure level.

COMPARATIVE EXAMPLE 7

A timber piece of oak cut to the sample size was dried at 105° C. for 10 hours to have a reduced moisture content of 5%. Without the plasma treatment, the timber piece was coated with an urethane resin coating for evaluation of the coating adherence by means of the cross-cut tape method in accordance with JIS K-5400, 8-5-2. The results is listed in Table 2.

COMPARATIVE EXAMPLE 8

A timber piece of oak was cut to the sample size having a moisture content of 50% (above fiber saturation point). Without the plasma treatment, the timber piece was tested to give contacts angle with the water drop at the three points, as listed in Table 2.

As apparent from Tables 1 and 2, it is confirmed that the desired surface improvement is obtained substantially uniformly over the timber surface when the timber pieces are pretreated to reduce its moisture content below its fiber saturation point prior to the plasma treatment and that the plasma treatment is made at a near atmospheric pressure level in the range of 500 to 1500 mmHg.

What is claimed is:

1. A process of improving timber surface properties comprising the following steps of:

reducing a moisture content of a timber below a fiber saturation point for said timber; and exposing said timber to a plasma mixture of an inert gas and a reactive gas including at least one element selected from the group consisting of C, N, O, F, and S, said plasma mixture being generated by a glow-discharge at near atmospheric pressure.

2. A process as set forth in claim 1, wherein said inert gas is selected from the group consisting of He, Ar, and Ne.

3. A process as set forth in claim 1, wherein said plasma mixture is generated at a pressure range of 500 to 1500 mmHG.

4. A process as set forth in claim 1, wherein said reactive gas is contained in said inert gas in a molar ratio of less than 0.3 to 1.

5. A process as set forth in claim 1, wherein said glow-discharge is effected by applying an voltage difference between a pair of electrodes at an electric power of 0.02 to 6.0 Watts per square centimeters of said electrodes.

6. A process as set forth in claim 1 or 5, wherein said glow-discharge is effected by applying a voltage difference between a pair of electrodes at a frequency range of 1 kHz to 13.56 MHz.

* * * * *